US005499005A

United States Patent [19]

Gu et al.

[11] Patent Number: 5,499,005

[45] Date of Patent: Mar. 12, 1996

[54] TRANSMISSION LINE DEVICE USING STACKED CONDUCTIVE LAYERS

[76] Inventors: Wang-Chang A. Gu, 9508 San Gabriel, NE., Albuquerque, N.M. 87111; Richard S. Kommrusch, 938 Bobcat Blvd., NE., Albuquerque, N.M. 87122; Rong-Fong Huang, 8216 Tina Dr., NE., Albuquerque, N.M. 87109

[21] Appl. No.: 187,951

[22] Filed: Jan. 28, 1994

[51] Int. Cl.[6] ..... H01P 5/00

[52] U.S. Cl. ..... 333/246; 333/161; 333/162; 336/200

[58] Field of Search ..... 333/26, 116, 128, 333/161, 162, 204, 238, 246; 336/84 R, 200

[56] References Cited

U.S. PATENT DOCUMENTS

| | | | |
|---|---|---|---|
| 3,849,745 | 11/1974 | Schellenberg et al. | 333/238 X |
| 4,494,083 | 1/1985 | Josefsson et al. | 333/246 X |
| 4,701,727 | 10/1987 | Wong | 333/204 |
| 4,916,417 | 4/1990 | Ishikawa et al. | 333/238 X |
| 5,146,191 | 9/1992 | Mandai et al. | 333/161 |
| 5,369,379 | 11/1994 | Fujiki | 333/116 |

FOREIGN PATENT DOCUMENTS

| | | | |
|---|---|---|---|
| 21806 | 2/1983 | Japan | 336/200 |
| 154607 | 7/1987 | Japan | 336/200 |
| 7405 | 1/1990 | Japan | 336/84 R |

*Primary Examiner*—Paul Gensler
*Attorney, Agent, or Firm*—James A. Coffing

[57] ABSTRACT

A transmission line device (200) employs a first ground plane (118) that is disposed on a first dielectric substrate (202). A first conductive layer (210) that encloses a first area (213)is disposed on a second dielectric substrate (206), which substrate is positioned substantially adjacent to the first dielectric substrate (202). A second conductive layer (211) that encloses an area corresponding to the first area (213) is disposed on a third dielectric substrate (207), which substrate is positioned substantially adjacent to the second dielectric substrate (206). A coil structure is thereby provided that can be employed in the fabrication of a transmission line device, according to the invention.

2 Claims, 4 Drawing Sheets

100

200

300

400

500

TRANSMISSION LINE DEVICE USING STACKED CONDUCTIVE LAYERS

FIELD OF THE INVENTION

The present invention relates generally to electrical circuits, and in particular to such circuits that require low volume transmission line devices.

BACKGROUND OF THE INVENTION

Electrical transmission lines are used to transmit electric energy and signals from one point to another. The basic transmission line connects a source to a load—e.g. a transmitter to an antenna, an antenna to a receiver, or any other application that requires a signal to be passed from one point to another in a controlled manner. Electrical transmission lines, which can be described by their characteristic impedance and their electrical length, are an important electric component in radio frequency (RF) circuits. In particular, transmission lines can be used for impedance matching—i.e., matching the output impedance of one circuit to the input impedance of another circuit. Further, the electrical length of the transmission line, typically expressed as a function of signal wavelength, represents another important characteristic of the transmission line device.

Manipulation of the characteristic impedance and electrical length of the transmission line device is a well known technique to-effect a particular electrical result. In particular, an output impedance, $Z_{out}$, can be matched to an input impedance, $Z_{in}$, according to a well known equation, as later described. Similarly, the attenuation and phase shift of the transmission line device can be altered by changing the physical length of the conductor between the input and output ports of the transmission line device. As an example, a resonant circuit results when the physical length of the conductor approximates an even one-quarter wavelength of the signals nominal frequency.

Of course, at high frequencies the wavelength is small and transmission line devices can be built using relatively short conductors in small packages. By contrast, as the nominal frequency of the applied signal decreases, the physical length must necessarily increase to effect the desired transmission line characteristic. The physical length must correspondingly increase to accommodate such applications operating at lower frequencies.

Prior art techniques, including microstrip and stripline conductors, have been used successfully in the past to construct transmission line devices. Unfortunately, at lower frequencies—e.g., below 1 GHz-the substrates upon which these one-dimensional conductive strips are placed require a relatively large area, due to the excessive length requirements. As today's electronic devices shrink in size, the board space allotted for the necessary electrical components is correspondingly reduced. Thus, a substrate carrying a microstrip or a stripline conductor that serves as a transmission line device for low frequency signals simply cannot be accommodated by the available board space.

Another technique that is employed can be described as a helical structure disposed inside a grounding cylinder. Such helical coils are well known in the art, but these too are often inadequate for today's applications, where low volume and low cost are critical factors in the manufacture of portable electronic devices. Because of the tight length and impedance specifications, the helical structures become very costly to manufacture. That is, the manufacturing variance that is inherent in the construction of such devices—e.g. conductor diameter, symmetry of windings, and effective number of turns—tends to make the helical structure a less desirable solution for tight tolerance transmission line devices. Further, the cylindrical grounding portion, which feature is required when building a transmission line device, results in a circuit having a relatively large volume, or poor form-factor, that is untenable for many of today's applications.

Accordingly, a need exists for a transmission line device that is not constrained by the shortcomings of the prior art. In particular, a device having a substantially lower volume—or one having a better form-factor—than its predecessors would be an improvement over the prior art. Such a device that was also cost effective to manufacture, and could be used at lower operating frequencies, would further provide a distinct advantage over prior art transmission line devices.

DETAILED DESCRIPTION OF A PREFERRED EMBODIMENT

A device having transmission line characteristics can be formed using a multilayer ceramic processing technique. The transmission line device includes at least a first ground plane located on a first dielectric substrate. A first and second conductive layer are disposed on additional dielectric substrates that are substantially adjacent to the first dielectric substrate. The first and second conductive layers each at least partially enclose a corresponding area on their respective dielectric substrates. Arranging the conductive layers and the substantially adjacent ground plane in this manner facilitates a design requiring increased electrical length and a more controllable characteristic impedance for the transmission line device. Further, this arrangement advantageously employs relatively inexpensive multilayer techniques, and therefore provides a low cost, low volume solution to the problems of the prior art.

Figure 1:
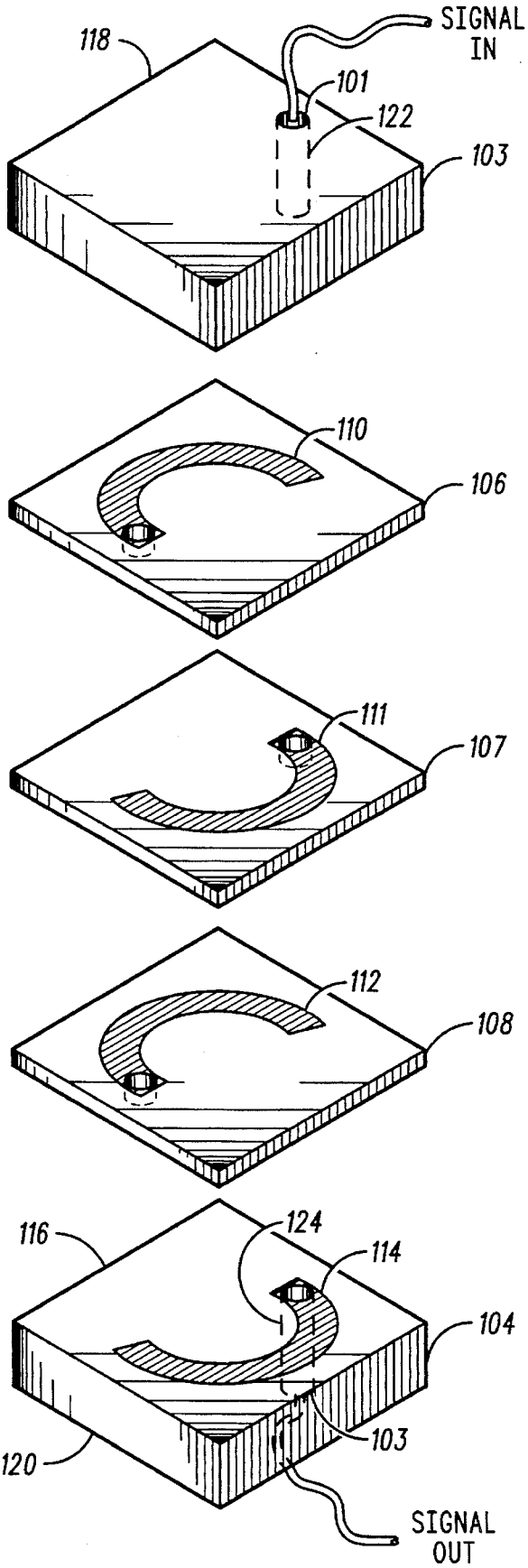
FIG. 1 shows a multilayer ceramic transmission device using vertically stacked half-ring conductors, in accordance with one embodiment of the present invention.

The present invention can be more fully described with reference to FIGS. 1–5. FIG. 1 shows a multilayer substrate arrangement 100 that, when assembled, provides a device having transmission line characteristics. That is, a transmission line device is formed between a signal input port 101 disposed on a top substrate 102 and a signal output port 103 disposed on a bottom substrate 104. Further, intermediate substrates 106–108 (three shown, but could be more or less, as necessary) provide support structure for conductive patterns, or layers 110–112, which layers at least partially enclose an area on their respective dielectric substrates 106–108. Though not shown, conductive patterns 110–112 are connected by conductive vias at alternating ends of each half-ring to form a continuous conductive path. Another conductive layer 114 is disposed on a first major surface 116 of the bottom substrate 104, and connected to the others using a conductive via, not shown. The top substrate 102 further includes a metallized area 118 that serves as a ground plane for the transmission line device. Similarly, the bottom substrate 104 preferably includes a second ground plane, disposed on a second major surface 120 thereof, which second ground plane generally insures a more stable circuit package due to the shielding, symmetry and boundary effects of the second ground plane. Finally, conductive vias 122, 124 are used to carry the input and output signals through the top substrate 102 and the bottom substrate 104, respectively. In this manner, a multiple-turn coil is provided that is substantially adjacent to one, or preferably two, ground plane(s) to effect a low-volume transmission line device.

In a preferred embodiment, the dielectric substrates 102, 104, 106–108 are formed using ceramic materials that can be co-fired with a co-fireable metal composition. Further, the conductive layers 110–112, 114 are preferably deposited on the dielectric substrates as provided by, for example, DuPont's Green Tape™, Systems, thereby producing conductive layers having relatively high conductance values. Similarly, the conductive vias 122, 124—as well as the vias formed on the intermediate substrates 106–108, not shown—are made by at least partially filling the volume of spatially arranged, pre-punched holes in the ceramic using the co-fireable metal composition. Lastly, it should be noted that while conductive layers 110–112 are shown in FIG. 1 as being annulus structures in the form of a half-ring, other annulus structures can be readily employed depending on the application requirements, as next described. Further, while input/output terminals are shown here as being on opposite surfaces of the package, it is understood that they could easily be placed on the same surface. It is critical only that the transmission line device is electrically positioned between the input and output terminals.

Figure 2:
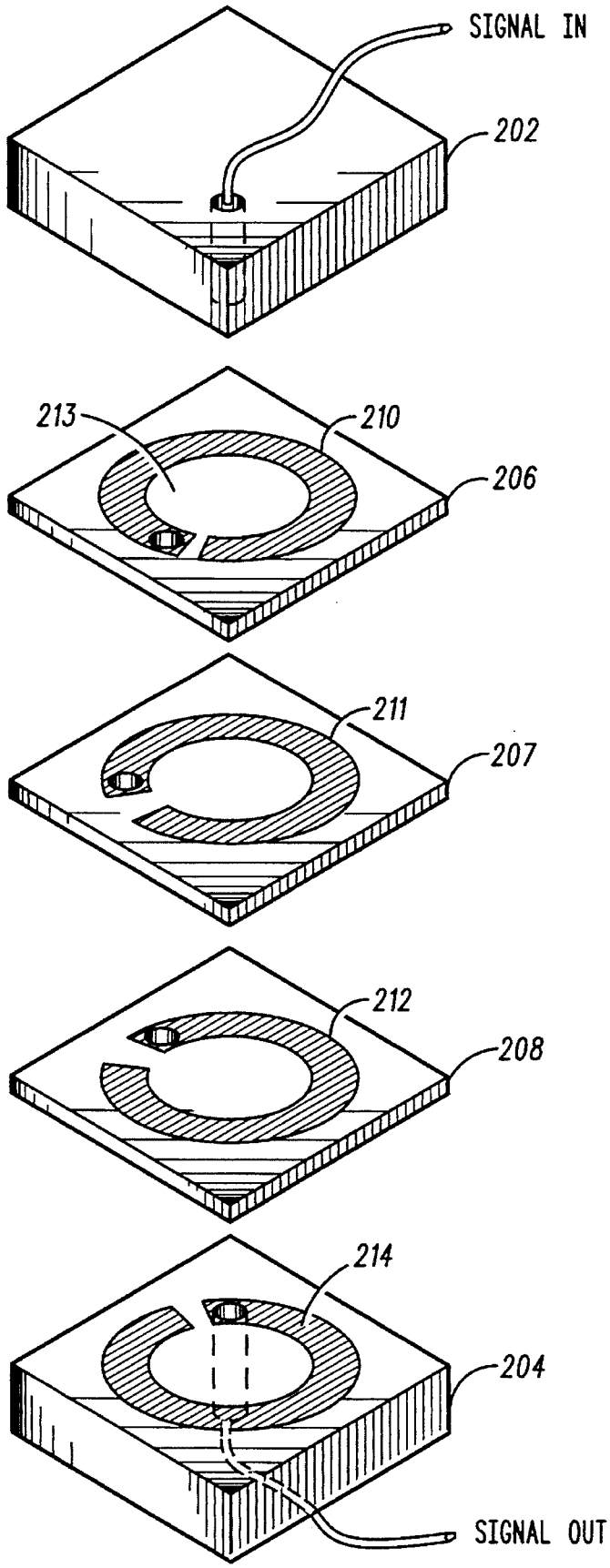
FIG. 2 shows a multilayer ceramic transmission device using vertically stacked full-ring conductors, in accordance with a second embodiment of the present invention.

FIG. 2 shows a multilayer substrate arrangement 200 that employs full-ring annulus structures as the conductive layers between dielectric substrates 202 and 204, in accordance with an alternate embodiment of the invention. That is, annulus 210 comprises a nearly complete circular layer that substantially encloses an area 213 on dielectric substrate 206. Similarly, annuli 211, 212, 214 comprise near complete circular layers that substantially enclose areas on their dielectric substrates 207, 208, and 204, respectively, which areas correspond to the substantially enclosed area 213. Employing annulus structures 210–212, 214 in this manner provides for increasing the physical length of the conductive layers-and hence the electrical length of the transmission line-using the same number of ceramic layers. Of course, this allows for reduced volume of dielectric material required and significantly lower manufacturing costs, as compared to transmission line designs of the prior art.

Figure 3:
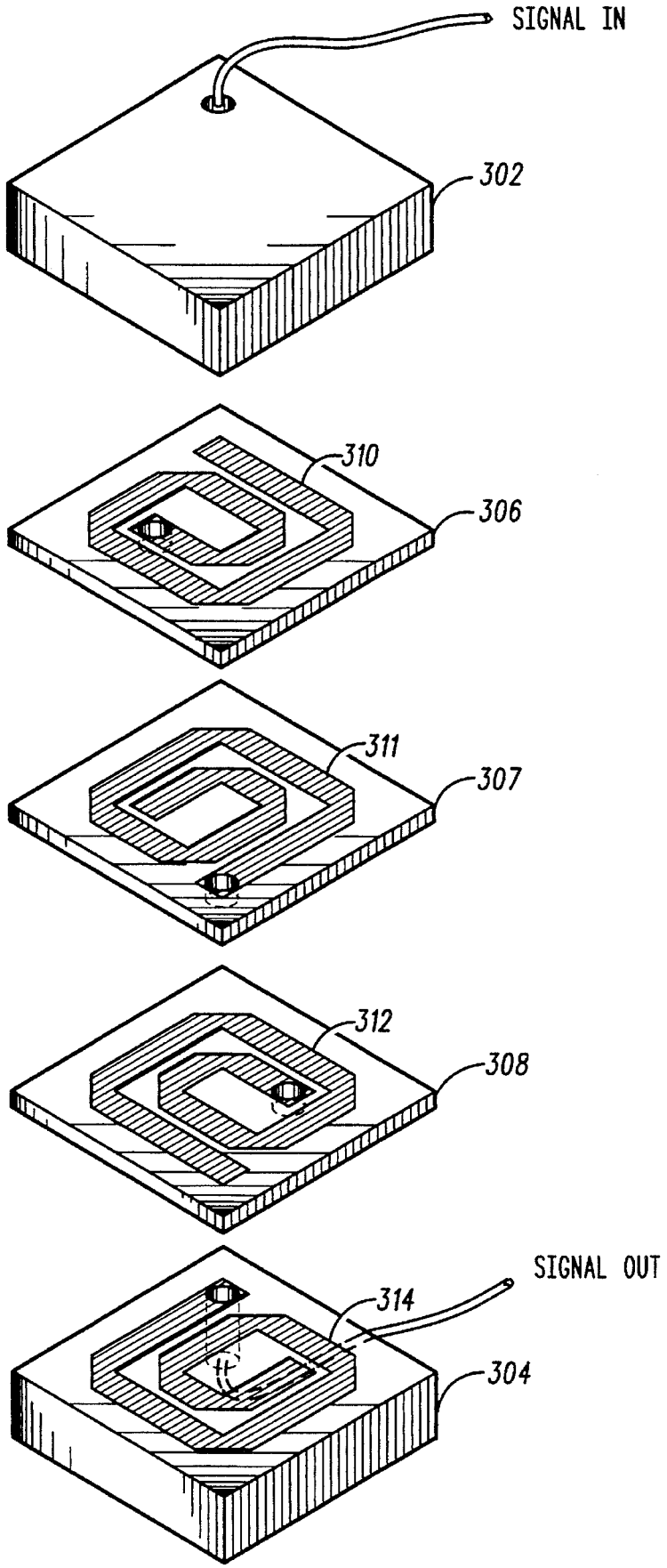
FIG. 3 shows a multilayer ceramic transmission device using vertically stacked spiral conductors, in accordance with a third embodiment of the present invention.

FIG. 3 shows yet another multilayer substrate arrangement 300 that employs spiral structures as the conductive layers. In particular, spiral conductors 310–312 and 314 are disposed on dielectric substrates 306–308 and 304, respectively, to effect a multilayer transmission line device in accordance with the present invention. Like the full-ring annulus structures described with reference to FIG. 2, the spiral structures advantageously provide increased physical—and electrical—length for those applications with such requirements. Generally, such applications include those circuits operating in the 100 MHz–3 GHz frequency range, which frequencies require longer conductive lengths than do high frequency applications. Accordingly, the present invention allows for the manufacture of a low-volume transmission line device that can be used at frequencies substantially lower than those frequencies attainable using prior art techniques.

Figure 4:
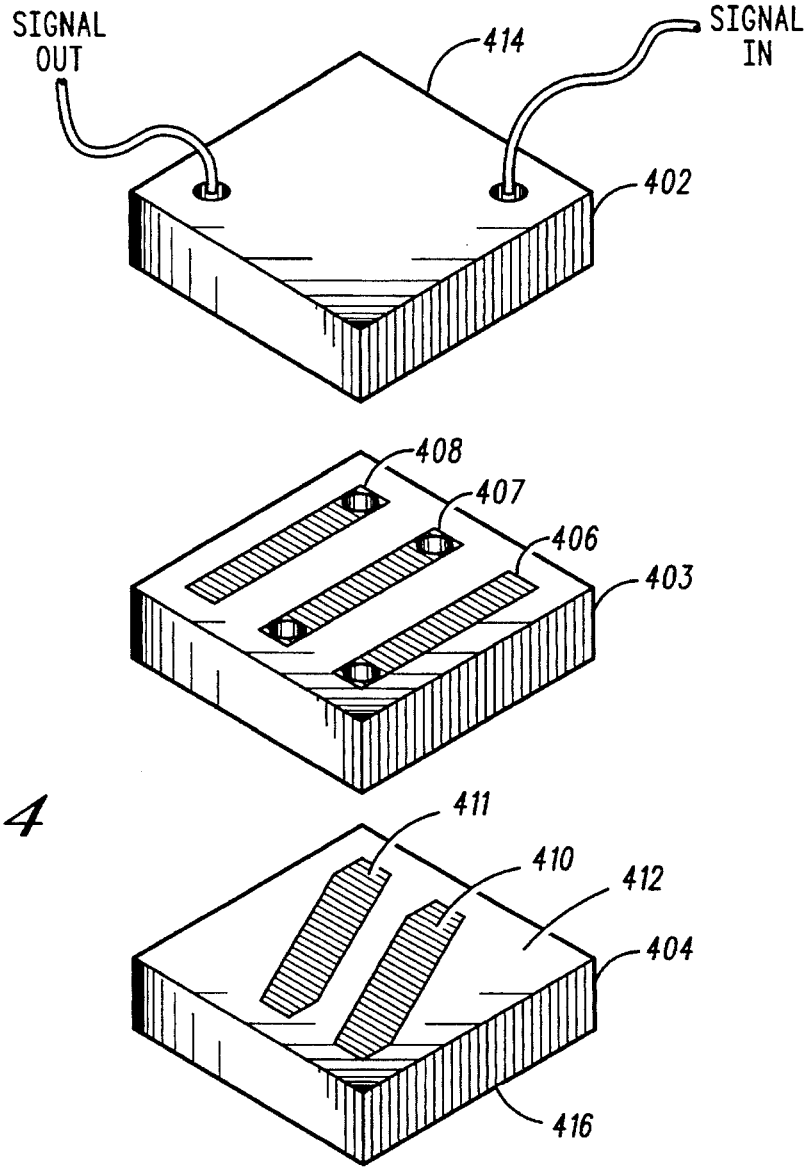
FIG. 4 shows a multilayer ceramic transmission device using horizontally stacked strip conductors, in accordance with yet another embodiment of the present invention.

While FIGS. 1–3 illustrate the use of vertically stacked conductive layers on a plurality of vertically adjacent dielectric substrates, the present invention further anticipates the use of conductive layers that are horizontally stacked on two or more substrates. FIG. 4 shows a multilayer substrate arrangement 400 that employs a plurality of conductive strips arranged on adjacent dielectric substrates to effect a device having transmission line characteristics. As with the vertically stacked embodiments earlier described, the horizontally stacked arrangement includes a top substrate 402 and a bottom substrate 404, as well as conductive vias—not shown—for carrying the input/output signals to/from the intermediate dielectric substrate. Dielectric substrate 403 includes the horizontally stacked conductive strips 406–408 (three shown, but could be more or less, as necessary), and conductive vias—also not shown—for passing the electrical signal between the dielectric layers. Conductive strips 410, 411, are horizontally arranged on a first major surface 412 of dielectric substrate 404 and coordinate with conductive layers 406–408 to form a multiple-turn coil. The multilayer arrangement 400 further includes a metallized area 414 that serves as a ground plane for the transmission line device. Similarly, a second major surface of dielectric substrate 404 preferably includes a metallized area 416 that serves as a second ground plane for the transmission line device.

It should be noted that, while FIG. 4 illustrates a coil having only a few turns, it is understood that the dielectric substrates 403, 404 could have many conductive strips, horizontally arranged to provide the required number of turns (i.e., for increased electrical length). By building a multilayer device in this manner, a low-profile transmission line device is produced that is capable of operating at much lower frequencies than its prior art counterpart.

Figure 5:
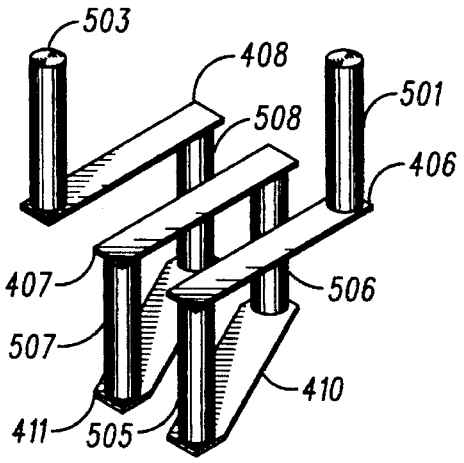
FIG. 5 shows a more detailed view of the multiple-turn coil shown in FIG. 4.

FIG. 5 shows a more detailed view 500 of the multiple-turn coil shown in FIG. 4. This view illustrates the role of conductive strips 406–408, 410, 411 and the conductive vias 501,503, 505–508 play in defining the area enclosed by the multiple-turn coil. In this particular embodiment, it can be seen that conductive strips 406–408, 410, 411 coordinate with conductive vias 505–508 to produce an effective coil-like structure. It is this coil structure that propagates the electromagnetic signal that is critical to transmission line applications. It should be noted that, while they do not contribute here, conductive vias 501, 503— used to facilitate the input/output signals-could be turned downward (through dielectric substrates 403, 404 respectively) to contribute to the number of turns provided by the coil.

What is claimed is:

1. A transmission line device that includes a plurality of stacked dielectric substrates, comprising:

a first ground plane disposed on a first of the plurality of stacked dielectric substrates;

a first non-grounded conductive annulus, having a first end electrically connected to an input port for the transmission line device and a second end, that at least partially encloses a first area on a second of the plurality of stacked dielectric substrates a second conductive annulus, electrically connected at a first end to the second end of the first non-grounded conductive layer, that substantially encloses a second area corresponding to the first area on a first major surface of a third of the plurality of stacked dielectric substrates;

a third conductive annulus disposed on a fourth of the plurality of stacked dielectric substrates, and second conductive means for connecting the second conductive annulus to the third conductive annulus;

wherein a vertically-stacked multiple-turn coil is formed using the first conductive annulus, the second conductive annulus and the third conductive annulus.

2. A transmission line device that includes a plurality of stacked dielectric substrates, comprising:

a first ground plane disposed on a first of the plurality of stacked dielectric substrates;

a first non-grounded conductive annulus, having a first end electrically connected to an input port for the transmission line device and a second end, that at least partially encloses a first area on a second of the plurality of stacked dielectric substrates;

a second conductive annulus, electrically connected at a first end to the second end of the first non-grounded conductive annulus, that substantially encloses a second area corresponding to the first area on a first major surface of a third of the plurality of stacked dielectric substrates;

a third conductive annulus disposed on a first major surface of a fourth of the plurality of stacked dielectric substrates:

conductive means for connecting the second conductive annulus to the third conductive annulus; and a second ground plane disposed on a second major surface of the fourth dielectric substrate;

wherein a vertically-stacked multiple-turn coil is formed using the first conductive annulus, the second conductive annulus and the third conductive annulus.

* * * * *